United States Patent [19]

Swanson

[11] Patent Number: 4,606,812

[45] Date of Patent: Aug. 19, 1986

[54] HYDROTREATING OF CARBONACEOUS MATERIALS

[75] Inventor: Rollan Swanson, Eureka, Nebr.

[73] Assignee: Chemroll Enterprises, Inc., New York, N.Y.

[21] Appl. No.: 549,565

[22] Filed: Nov. 7, 1983

Related U.S. Application Data

[63] Continuation of Ser. No. 140,604, Apr. 15, 1980, abandoned.

[51] Int. Cl.[4] ..... C10G 23/00

[52] U.S. Cl. ..... 208/108; 208/107; 208/251 H; 208/143; 208/208 R; 208/209; 208/213; 208/223; 208/231; 208/232; 208/251 H; 208/253; 208/254 H; 208/264; 208/284; 208/288; 208/293; 208/420; 208/428; 208/951

[58] Field of Search ..... 208/107, 108, 143, 209, 208/213, 230, 231, 232, 251 H, 253, 254 H, 254 R, 208 M, 284, 208 R, 288, 293, 223, 251, 264, 10, 11 R

[56] References Cited

U.S. PATENT DOCUMENTS

| | | | |
|---|---|---|---|
| 1,300,816 | 4/1919 | Cobb . | |
| 1,822,349 | 9/1931 | Jannek et al. | 208/8 LE |
| 1,899,042 | 2/1933 | Malisoff | 208/232 |
| 1,904,586 | 4/1933 | Winkler et al. | 208/8 |
| 2,306,484 | 12/1942 | McClintock | 208/253 |
| 2,379,654 | 7/1945 | Royer | 208/230 |
| 3,252,774 | 5/1966 | McMahon et al. | 48/214 |
| 3,294,678 | 12/1966 | Gleim | 208/253 |
| 3,354,081 | 11/1967 | Aldridge | 208/230 |
| 3,383,304 | 5/1968 | Mattox et al. | 208/232 |
| 3,387,941 | 6/1968 | Murphy et al. | 208/230 |
| 3,449,242 | 6/1969 | Mattox et al. | 208/227 |
| 3,474,028 | 10/1969 | Bulian et al. | 208/230 |
| 3,594,309 | 7/1971 | Stolfa | 208/89 |
| 3,617,502 | 11/1971 | Stolfa | 208/89 |
| 3,617,529 | 11/1971 | Thompson et al. | 208/230 |
| 3,647,680 | 3/1972 | Greenwood et al. | 208/65 |
| 3,725,250 | 4/1973 | Wilson et al. | 208/208 R |
| 3,787,315 | 1/1974 | Bearden et al. | 208/230 |
| 3,788,978 | 1/1974 | Bearden et al. | 208/208 M |
| 3,816,298 | 6/1974 | Aldridge | 208/112 |
| 3,976,559 | 8/1976 | Bearden et al. | 208/89 |
| 3,976,562 | 8/1976 | Eberly, Jr. | 208/216 |
| 3,992,285 | 11/1976 | Hutchings | 208/208 |
| 4,003,823 | 1/1977 | Baird et al. | 208/230 |
| 4,018,572 | 4/1977 | Swanson | 208/230 |
| 4,110,197 | 8/1978 | Herming et al. | 208/64 |
| 4,119,528 | 10/1978 | Baird et al. | 208/108 |
| 4,160,721 | 7/1979 | Swanson | 208/230 |
| 4,230,184 | 10/1980 | Blytas | 208/230 |
| 4,248,695 | 2/1981 | Swanson | 208/232 |
| 4,441,923 | 4/1984 | Swanson | 75/28 |
| 4,454,017 | 6/1984 | Swanson | 208/11 |
| 4,468,316 | 8/1984 | Swanson | 208/59 |

FOREIGN PATENT DOCUMENTS

| | | |
|---|---|---|
| 2558505 | 11/1976 | Fed. Rep. of Germany . |
| 1478490 | 6/1977 | United Kingdom . |

*Primary Examiner*—Charles F. Warren
*Assistant Examiner*—Joseph A. Boska
*Attorney, Agent, or Firm*—Richard M. Barnes

[57] ABSTRACT

A process for hydrotreating carbonaceous materials is disclosed. The carbonaceous material is contacted with steam and with empirical hydrates of alkali metal hydrosulfides, monosulfides, or polysulfides. The process hydrocracks, hydrogenates, denitrogenates, demetallizes, and desulfurizes. In a preferred embodiment, hydrogen sulfide is co-fed to the reaction zone.

30 Claims, No Drawings

HYDROTREATING OF CARBONACEOUS MATERIALS

This is a continuation of application Ser. No. 140,604, filed Apr. 15, 1980, entitled "Hydrotreating of Carbonaceous Materials," now abandoned.

BACKGROUND OF THE INVENTION

Many processes are known for treating petroleum oils and the like with alkali metal compounds or sulfides. Such processes are disclosed in U.S. Pat. Nos. 1,300,816, 1,413,005, 1,729,943, 1,938,672, 1,974,724, 2,145,657, 2,950,245, 3,112,257, 3,185,641, 3,252,774, 3,368,875, 3,354,081, 3,382,168, 3,483,119, 3,553,279, 3,565,792, 3,617,529, 3,663,431, 3,745,109, 3,787,315, 3,788,978, 3,816,298, 4,003,823, 4,007,109, 4,018,572, and 4,119,528.

For example, U.S. Pat. No. 3,252,774 discloses a process for cracking liquid hydrocarbons to produce hydrogen-containing gases by contacting the feedstock with a melt of an alkali metal compound (e.g., the sulfides), at temperatures between about 800° and 1800° F. in the presence of steam.

U.S. Pat. No. 3,617,529 discloses removing elemental sulfur from petroleum oil by contacting the oil at ambient temperature with an aqueous solution containing sodium hydrosulfide alone or in combination with sodium hydroxide and ammonium hydroxide. The aqueous solution and oil are separated, and the aqueous solution is treated to free the sulfur from the polysulfides that are formed during the contacting step.

U.S. Pat. Nos. 3,787,315 and 3,788,978 disclose processes for desulfurizing petroleum oil. The oil is contacted with an alkali metal or alloy in the presence of hydrogen to form a sulfide, thereby desulfurizing the oil. The sulfide is separated from the oil by treating with hydrogen sulfide, and the separated monosulfide is treated with a sodium polysulfide to form a polysulfide of lower sulfur content, which is then electrolyzed to produce sodium.

U.S. Pat. No. 3,816,298 discloses a two-stage process for upgrading (partially desulfurizing, hydrogenating, and hydrocracking) heavy hydrocarbons (e.g., vacuum residuum) into liquid hydrocarbon products and a hydrogen-containing gas. In the first stage, the hydrocarbon feed is contacted with a gas containing hydrogen and carbon oxide in the presence of any of numerous catalysts, including alkali metal sulfides and hydrosulfides. The pressure must be above 150 psig and the average temperature between about 700° and 1,100° F. An example shows feeding steam (as well as hydrogen and carbon oxides) to the first stage with $K_2CO_3$ catalyst, at 340 psig and 910° F. A by-product, solid carbonaceous material, is deposited on the catalyst and a portion of the catalyst is sent to the second reaction stage where it is contacted with steam, at a pressure above 150 psig and an average temperature above 1,200° F.

U.S. Pat. No. 4,003,823 discloses another process for upgrading heavy hydrocarbons, by contacting them with alkali metal hydroxides, at hydrogen pressures of from about 500 to 5,000 psig and temperatures of from about 500° to 2,000° F. Hydrogen sulfide may be added to the products withdrawn from the reaction zone to convert alkali metal sulfides formed in the reactor to hydrosulfides, as the first step in regenerating the alkali metal hydroxides.

U.S. Pat. No. 4,018,572 discloses a process for desulfurizing fossil fuels by contacting the material with aqueous solutions or melts of alkali metal polysulfides to form salts with higher sulfur content, which are decomposed to regenerate the polysulfides of reduced sulfur content.

Finally, U.S. Pat. No. 4,119,528 discloses another process for treating heavy carbonaceous feedstocks, using potassium sulfide and hydrogen pressure of from about 500 to 5,000 psig and temperatures of from 500° to 2,000° F. The products are desulfurized, lower-boiling oils and potassium hydrosulfide, which may be converted back to potassium sulfide. The potassium sulfide may be charged to the reactor as such or made in situ by reacting various potassium compounds with sulfur compounds, such as hydrogen sulfide. The potassium sulfide may also be made by reducing potassium compounds, such as the hydrosulfide or the polysulfides, with reducing agents, such as hydrogen. The sulfide may also be made by the high temperature steaming of potassium hydrosulfide. Preferably, a mixture of potassium and sodium sulfides is used because the sodium sulfide acts as a "getter" for the hydrogen sulfide produced during reaction that would otherwise react with the potassium sulfide to form "inactive" potassium hydrosulfide.

None of these discloses the use of empirical hydrates of alkali metal hydrosulfides, sulfides, or polysulfides to hydrotreat (e.g., hydrogenate and hydrocrack) carbonaceous material.

SUMMARY OF THE INVENTION

It has now been discovered that empirical hydrates of certain alkali metal sulfur compounds can be used to hydrotreat carbonaceous material. As used herein, the term "carbonaceous material" includes oils, shale, tar sands, and the like, but not coal, which, for various reasons, is not treated using the present process. (See U.S. Patent Application Ser. Nos. 63,824, filed Aug. 6, 1979, and 114,207, filed Jan. 22, 1980.) Thus, the term "carbonaceous material" embraces crude oils, atmospheric resids (cracked and uncracked), and vacuum resids (vis- and non-vis-broken), and non-petroleum oils. "Hydrotreating" includes hydrogenating and hydrocracking. The term "empirical hydrates" is used because the reagents of this invention appear to be hydrates in that they contain bound or associated water that is freed at discrete temperatures as the reagents are heated.

In accordance with the present process, the carbonaceous material to be treated is contacted with the novel reagents in the presence of steam. The steam is essential because it maintains the reagents in their empirically hydrated (high-activity) forms.

The novel process provides many benefits. First, denitrogenation and demetallizing occur concomitantly with the hydrotreating. Additionally, depending on process conditions and on which reagents are used, desulfurization may also take place. (See U.S. Pat. No. 4,160,721, issued July 10, 1979 to Rollan Swanson, which discloses a desulfurization process).

Second, the reaction conditions can be much milder than for any other known hydrotreating process. The reaction temperature need not be greater than about 410° C. and the pressure need not be above atmospheric.

Third, the efficiency and degree of hydrotreating achievable are very high. For example, in a preferred embodiment wherein hydrogen sulfide is co-fed to the reaction zone, essentially all of the products resulting from treating in one pass a resid having an initial boiling point of over 343° C. boil at temperatures below 343° C.

Other advantages of the present process will be apparent from the following description.

DETAILED DESCRIPTION OF THE INVENTION

Broadly, the process comprises contacting the carbonaceous material with the reagent. The carbonaceous material will usually be employed in the liquid phase, but preliminary research indicates that vapor phase contact may also be used. Steam is passed through the reaction mixture to maintain the reagent in its empirically hydrated (highly reactive) form. (For carbonaceous materials high in naphthenic acids, the steam flow is kept to a minimum because water tends to decompose these materials. In such cases, hydrogen may be advantageously co-fed.) Liquid water causes the reagent to decompose and thus the reaction conditions should be chosen to prevent the presence of a significant amount of liquid water. Preferably, conditions are chosen so that there is essentially no liquid water in the reaction zone.

The reaction mixture is heated to vaporize treated product, and the steam and product are withdrawn from the reaction zone, cooled, and separated. If desired, the product may be taken off as a series of distillation cuts and the heavier (higher boiling temperature) cuts recycled for further treatment. The steam and vaporized product need not be withdrawn continuously or at all; however, without periodic withdrawal, the pressure will rise and cause the steam to condense. This in turn will decompose the reagent and halt reaction. Accordingly, it is preferred that there be at least periodic vapor removal, and continuous removal is most preferred.

Treatment may be carried out in almost any type of equipment. For example, a tank reactor could be used. A staged, column reactor, allowing product cuts to be taken off overhead and as sidestreams, could also be used. The process may be run in continuous or batch fashion and with one or more reaction stages. A tank reactor would usually be operated batch-wise; a staged column lends itself to continuous operation.

In a preferred embodiment, hydrogen sulfide is also fed to the reaction zone to contact the reaction mixture. This regenerates a portion of the reagent and results in higher productivity. As explained below, hydrogen sulfide is produced during treatment and is withdrawn with the steam and vaporized product. Accordingly, it is most advantageous if the hydrogen sulfide withdrawn is recycled to the reaction zone.

The reaction temperatures are comparatively low, generally between approximately 40° and 410° C. For certain materials (e.g., vacuum resids), essentially no reaction occurs until the temperature is relatively high (e.g., 370° C.). The pressures need not be above atmospheric, but engineering design considerations may dictate that higher pressures be used, for example, to reduce the diameter (and cost) of a column-type reactor. Whatever conditions are employed, they should not result in condensation of a significant amount of the steam, and preferably essentially none of the steam condenses.

The reagents used herein are the empirical hydrates of the hydrosulfides, monosulfides, and polysulfides of the Group IA elements of the Periodic Table other than hydrogen. For various reasons, the francium and cesium compounds are not generally used. Thus, the sodium, potassium, lithium, and rubidium compounds will more often be used. The potassium, rubidium, and sodium compounds are preferred, and the potassium are most preferred. (However, in some cases, e.g., with Heavy Canadian Crude Oil, the sodium reagents have been superior to the potassium.) A reagent of three hydrosulfides equivalent to 14% rubidium hydroxide, 29% potassium hydroxide, and the rest sodium hydrosulfide (based on the total of the two hydroxides and one hydrosulfide) has been found to be the most effective.

During reaction, at low temperatures the reagent is actually a mixture of the empirical hydrates of the hydrosulfide and sulfides (mono and poly) of each alkali metal employed, and during reaction there is interconversion of these sulfur-containing forms. (As the reaction temperature rises, some of these forms disappear because their decomposition temperatures have been exceeded.) Accordingly, the reagent may be charged initially to the reaction zone as the hydrosulfide empirical hydrate or as one or more of the sulfide hydrates or as a mixture of the hydrosulfide and sulfide empirical hydrates. The empirical hydrate reagents may also be made in situ, but preferably they are charged in their empirical hydrate form. (Each of the alkali metal hydrosulfides and mono- and polysulfides may have more than one empirical hydrate, but unless otherwise noted, the term "empirical hydrate" is meant to include all the hydrates.)

More specifically, taking the potassium series as an example, there are six sulfides of potassium, $K_2S$, $K_2S_2$, $K_2S_3$, $K_2S_4$, $K_2S_5$, and $K_2S_6$, and one hydrosulfide, KHS. The molecule containing the greatest number of sulfur atoms may be thought of as being "saturated" with respect to sulfur (i.e., $K_2S_6$), and those containing less as being relatively unsaturated with respect to sulfur.

Considering now potassium monosulfide, for example, it crystallizes as an empirical pentahydrate. Under reaction conditions, at 162° C., the empirical pentahydrate decomposes to an empirical dihydrate, with the vigorous and observable liberation of three moles/mole of water. At 265°–270° C., further decomposition occurs to a lower empirical hydrate, with liberation of water. Some water of empirical hydration probably remains up to or near the melting point of 948° C. The liberation of water at discrete temperatures is clear evidence of the presence of bound or associated water analogous to water of hydration.

The present process denitrogenates and demetallizes as it hydrogenates and hydrocracks. The nitrogen leaves the system as ammonia vapor. The metals removed include vanadium, nickel, cobalt, and cadmium, and remain in the reagent left in the reaction zone. Additionally, if $H_2S$ is co-fed or if the less sulfur-saturated reagents are used, the process also desulfurizes.

Increasing the overall sulfur to alkali metal ratio in the reaction zone (including the sulfur in the carbonaceous material) tends to decrease the severity of cracking that occurs and to decrease the desulfurization. Lower sulfur to alkali metal ratios tend to increase the cracking severity and increase the desulfurization. If hydrogen sulfide is co-fed, the timing of its addition also affects the cracking severity. Commencement of addition before removal of all the liquid water (at about 110°–135° C.) decreases the severity; commencement of addition after removal increases the severity.

For the potassium reagents, overall ratios of 0.5/1 (equivalent to 100% $K_2S$) to 2.5/1 (equivalent to 100% $K_2S_5$) may be employed. However, for most carbonaceous materials, a more useful range is 0.55/1 to 1.5/1, and the preferred range is 0.75/1 to 1/1. The limits of the preferred range may be thought of as corresponding to $K_2S_{1.5}$ (0.75/1) and $K_2S_2$ (1/1). The preferred range for the sodium series is 0.55/1 to 1/1. Lower ratios may be required when processing materials that are difficult to crack, e.g., vacuum resids. If the sulfur to alkali metal ratio of the combined reagent and carbonaceous material is too low, elemental sulfur may be added; if too high, additional unsaturated reagent may be added.

The amount of reagent employed must be sufficient to provide adequate contact with the feedstock and the desired rate of reaction. The maximum amount of feedstock that can be processed with a given amount of catalyst is not known, but as much as 500 grams of a vacuum resid have been treated with 9.5 grams of KHS (as the empirical hydrate).

The reagents may be made in several ways. The manufacture of the preferred potassium reagents will be exemplified. First, sulfur in a 15% excess may be added to potassium in a liquid ammonia medium. This yields potassium sulfide hydrate (empirical hydrate). A portion of the hydrate is then reacted with additional sulfur to yield the pentasulfide empirical hydrate. The two hydrates are combined and used. This method is not preferred.

A second method is to dissolve potassium hydroxide in water and add just enough of a low-boiling alcohol (e.g., ethanol, propanol-1) to cause two layers to form. For example, 1 gram-mole of KOH is dissolved in 2 gram-moles of water. Sufficient alcohol (e.g., ethanol or higher) is added to form two layers (the total volume will be 160 milliliters or less), and then elemental sulfur is added to bring the S/K ratio to the desired value.

This second method yields almost exclusively empirical hydrates of sulfides and not of the hydrosulfide. The little hydrosulfide that is produced remains in the alcohol layer, and the water layer contains only sulfides. The water layer alone has been used successfully in hydrotreating runs. This evidences the viability of the sulfide reagents.

The third (and preferred method) involves dissolving potassium hydroxide in an alcohol in which the KOH is soluble and then contacting the solution with hydrogen sulfide. The alcohols will usually be primary alcohols, and methanol and ethanol are preferred because KOH is more soluble in these than in higher alcohols. The resulting mixture contains potassium hydrosulfide empirical hydrates. (This procedure may also be used to prepare the rubidium reagents. The sodium hydrosulfide reagents are not prepared this way; instead, commercially available flakes of NaHS empirical hydrate may be charged directly to the reaction zone.)

The manufacture of potassium hydrosulfide empirical hydrate reagent according to the preferred procedure is illustrated as follows. Two 1-liter graduated cylinders are each filled with slightly less than 600 milliliters of ethanol, and 3 gram-moles of potassium hydroxide are dissolved in each. A hydrogen sulfide source is connected to the first cylinder so as to introduce $H_2S$ near the bottom of the KOH-ethanol solution. The vapor overhead from the first cylinder is piped to a second cylinder and enters near the bottom of the solution therein.

The following overall reaction occurs:

$$H_2S + KOH = KHS + H_2O$$

This reaction is so rapid that if the $H_2S$ flow is too low, the solution in each cylinder will be drawn up its respective vapor feed tube. Gas flow to the first cylinder is halted as soon as $H_2S$ freely passes to the second cylinder, any precipitate in the first cylinder has been dissolved, and the temperature of the first cylinder has dropped below 22° C. At that point, the first cylinder contains high-quality reagent (potassium hydrosulfide empirical dihydrate ($KHS.2H_2O$) in ethanol) and should be removed from the system and stoppered.

A typical batch procedure for treating carbonaceous material in accordance with this invention using the the preferred potassium reagent made by the preferred method is as follows (petroleum oil is the carbonaceous material). The oil is charged to the reaction vessel and nitrogen (or another inert gas) is continuously sparged into the oil to agitate it as the oil is heated. (Mechanical means such as a magnetic stirrer may be used instead of gas agitation.) If elemental sulfur is required to raise the sulfur to alkali metal ratio, it may be added to oil at this point. The reagent mixture (potassium hydrosulfide empirical dihydrate in ethanol) is then added. (Alternatively, the extra sulfur may be added to the reagent mixture rather than to the oil.) The temperature is raised to approximately 130° C., and steam sparging is commenced. The steam flow need not be more than enough to cause bubbles to be visible on the surface of the oil. If the steam is providing sufficient agitation, the nitrogen sparging may be halted.

The overhead vapor is continuously withdrawn and variously contains the alcohol and water from the reagent mixture, steam, hydrogen sulfide from the reaction, and both vaporized and uncondensible hydrocarbon products from the treatment (assuming that the reaction initiation temperature has been reached). The overhead stream is cooled with cooling water and the resulting condensate is sent to a liquid-liquid separator. The uncondensed vapor may be fed to a cold trap (e.g., at −60° F.) to recover additional hydrocarbon products.

As the bulk temperature of the oil in the reactor rises, various overhead products are recovered in the overhead system. The nitrogen sparged into the oil starts to strip the alcohol and water added with the reagent almost as soon as the reagent is added (at about 40° C.). By 90° C., the first drops of a separate hydrocarbon layer are visible in the liquid-liquid separator. Before that, however, the light hydrocarbons produced (e.g., three-, four-, five-, and six-carbon compounds) have already come overhead, and at least a portion of them have dissolved in the alcohol in the separator.

By 135° C., distillation of the alcohol and water from the reagent mixture has been substantially completed. The water-alcohol layer in the separator preferably is withdrawn and recycled to the steam generator that provides the sparging steam. This ultimately returns the lighter hydrocarbons to the reaction vessel and tends to suppress further formation of them. Alternatively, the water and alcohol could be separated and only the water recycled. This would prevent "bumping" in the reaction vessel, caused by the revaporization of the recycled alcohol.

The temperature of the oil may be raised continuously or held at one or more temperatures (after steam flow is commenced at about 130° C.). Maintaining a low temperature for an extended period of time favors production of lighter products, but also results in more steam stripping of the heavier feedstock from the reaction zone.

Table I, below, indicates the cumulative quantities of products that were recovered in the liquid-liquid separator when processing a light crude oil with 11.75% (by weight) hydrogen when the oil was held at each indicated temperature above 140° C. for fifteen minutes (S/K ratio=1/1).

TABLE I

| Bulk Oil Temperature | Cumulative Products Recovered As A Percentage of Oil Feed |
|---|---|
| Up to 140° C. | approx. 24% (by weight) |
| 180° C. | approx. 38% (by weight) |
| 220° C. | — |
| 270° C. | approx. 59% (by weight) |
| 320° C. | — |
| 340° C. | approx. 96% (by weight) |

The residue in the reaction vessel was less than 2% (by weight) of the oil feedstock. During this run, approximately 4.7 grams of product were recovered in a −60° F. cold trap.

It has been found that excepting those oils high in naphthenic acids, no matter which light petroleum oil is processed in a batch system without addition of hydrogen sulfide, the hydrogen, nitrogen, and sulfur contents of various product cuts are within certain ranges. Table II, below, indicates these expected values. (The "Below 140° C. Cut" is that hydrocarbon material recovered while the bulk oil temperature is below 140° C. The "140°–170° C. Cut" is the material recovered when the bulk oil temperature is from 140° to 170° C., and so forth.)

TABLE II

| Product Cut (Oil Bulk Temp.) | Amount Of Element In Product Cut | | |
|---|---|---|---|
| | Hydrogen | Nitrogen | Sulfur |
| Below 140° C. | 13.8–14.1% | less than 0.05% | less than 0.05% |
| 140–170° C. | 13.4–13.6% | less than 0.05% | 0.07% |
| 170–270° C. | 13% | 0.1% | 0.36–0.48% |
| 270–340° C. | 12.4–13.0% | one-half initial | two-thirds initial |

Many variations in the processing sequence are possible. One or more of the product cuts may be recycled to the reactor for further cracking. For example, it is possible to recycle all of the products cuts recovered at bulk temperatures over 140° C. and produce essentially only a 140° C. net product.

Another variation is regenerating the reagent. This involves recovering the hydrogen sulfide in the vapor stream withdrawn from the reactor and treating the potassium compounds left in the reactor. To recover the $H_2S$ in the vapor stream, the overhead from the reactor is passed through a cooling water cooler, as before, and the uncondensed material is then passed through an alcohol wash to remove the lighter hydrocarbons because they hinder recovery of the hydrogen sulfide in the next step. (The alcohol wash solution may be recycled to the steam generator.) The remaining gas stream is then fed to an alkali metal hydroxide-in-alcohol solution, which removes the hydrogen sulfide in the gas stream by forming the alkali metal hydrosulfide or sulfide. This $H_2S$ removal step is essentially the same as the preferred method used to make fresh reagent. Desirably, a multi-stage $H_2S$ scrubber is used, and the vapor effluent from the last stage contains essentially no hydrogen sulfide.

To recover the potassium in the reactor (if potassium reagents are used) and regenerate the reagent, the solids in the reactor, comprising polysulfides and metal compounds formed during reaction, are withdrawn therefrom and approximately 3 moles of water per mole of potassium are added. Optionally, a volume of alcohol is added in an amount less than or equal to the volume of the aqueous solution. The alcohol stabilizes the reagent precursors during subsequent processing. The mixture is then cooled to less than 22° C., causing some alkali metal hydroxide to form, and hydrogen sulfide, which can be from an operating reactor, is bubbled through the mixture with cooling to maintain the temperature below 22° C. This causes sulfur to precipitate out, and the liquid is separated from the solids. The liquid is then heated to drive off most of the water and alcohol (if any were employed) and leave an empirical hydrate melt.

In the case of the potassium reagents, heating to a temperature of 105°–110° C. under a water atmosphere will leave an empirical hydrate melt containing approximately 35% (by weight) bound water. The melt is then dissolved in just enough low-boiling alcohol (preferably methanol or ethanol) to form a saturated solution. (More dilute solutions may be used but require additional energy to vaporize the surplus alcohol). In the case of the potassium reagents, at ambient temperature, approximately 150 milliliters of methanol or somewhat more of ethanol are required to dissolve 1 gram-mole of KHS. Hydrogen sulfide is bubbled through the solution at a temperature over 60° C., resulting in a solution of reagent in alcohol. The solution is then ready for use in the hydrotreating reactor; however, desirably the solution is first used to wash the hydrocarbon products. This clarifies the distillates, removes free sulfur therein, and tends to improve the effectiveness of the reagent.

In a preferred embodiment, hydrogen sulfide is fed to the reactor. The $H_2S$, apparently, tends to suppress decomposition or deactivation of the reagent, and, as noted above, depending on when its flow is commenced, the cracking severity tends to increase or decrease. The minimum and maximum amounts of hydrogen sulfide that can be used beneficially are not presently known.

The following examples are provided for illustrative purposes only and are not intended to limit the scope of the invention.

EXAMPLE I

One hundred sixty-four and one-half grams of a Texas crude oil, 2 grams of elemental sulfur, and 40 milliliters of a methanol solution containing 15.2 grams of KHS and 7.6 grams of water (the water bound in an empirical dihydrate) were placed in a flask, and the contents were agitated by nitrogen introduced below the surface of the liquid, near the bottom of the flask. The flask was heated by a heating mantel and a steam generator sparged steam into the liquid in the flask. Steam flow was started when the bulk liquid temperature was about 120° C.

The overhead vapors were fed to a cooling water condenser and the condensate was collected in a flask. During operation, the methanol-water condensate from the water-cooled condenser was periodically returned to the steam generator. The hydrocarbon condensates at different oil bulk temperatures (cuts) were periodically removed and analyzed. The uncondensed vapor was passed through a solution of 0.5 moles of KOH in 100 milliliters of methanol (removing essentially all the $H_2S$), through a water scrubber (removing methanol), and then through an isopropanol-dry ice bath (removing some lighter hydrocarbons). Analyses of the crude oil and of the product cuts are shown below.

| Material | Amount | Analysis | | |
|---|---|---|---|---|
| | | Hydrogen | Nitrogen | Sulfur |
| Crude Oil | 164.5 g | 12.11% | 0.14% | 1.51% |
| Below 140° C. Cut | 29.4 g | 13.87% | <0.05% | 0.05% |
| 140–170° C. Cut | 16.6 g | 13.6% | <0.05% | 0.07% |
| 170–275° C. Cut | 25.7 g | 13.1% | 0.07% | 0.8% |
| 275–340° C. Cut | 45.0 g | 12.3% | 0.1% | 1.1% |

There was no carbonaceous residue in the reaction flask, and the condensate from the cold trap totalled 22 milliliters.

The data indicate that the process hydrogenates, denitrogenates, and desulfurizes. All product cuts contain (in weight fractions) more bound hydrogen, less bound nitrogen, and less bound sulfur than does the crude oil. (The distillate from the cold trap was not analyzed but obviously has a greater fraction of bound hydrogen than does the crude oil.)

EXAMPLE II

Two hundred grams of an Alaskan crude oil were treated using the procedure of Example I except that steam flow was commenced at 135° C. and a cold trap was not used. Analyses of the crude oil and the products are shown below (there was essentially no oil residue in the flask).

| Material | Amount | Analysis | | |
|---|---|---|---|---|
| | | Hydrogen | Nitrogen | Sulfur |
| Crude oil | 200 g | 12.04 | 0.23% | 1.5% |
| Non-condensibles | 74 g | — | — | — |
| Below 140° C. Cut | 38.4 g | 13.99% | <0.05% | <0.05% |
| 140–180° C. Cut | 20.1 g | 13.77% | <0.05% | 0.07% |
| 180–343° C. Cut | 59.1 g | 12.8% | 0.1% | 0.9% |

EXAMPLE III

One hundred seventy-five grams of Trinidad crude oil were treated with 30 milliliters of a methanol reagent solution containing 11.4 grams of KHS and 5.7 grams of water (bound in the empirical hydrate). Because of its high naphthenic acid content, this oil is susceptible to degradation by water. Thus, a minimal amount of steam was used (the steam generator was kept at 99° C., at sea level) and gaseous hydrogen was also sparged. Analyses of the crude oil and products are shown below.

| Material | Amount | Analysis | | |
|---|---|---|---|---|
| | | Hydrogen | Nitrogen | Sulfur |
| Crude Oil | 175 g | 11.83% | 0.32% | 1.43% |
| Below 180° C. | | 13.01% | 0 05% | 0.24% |
| Cut Hydrocarbons in alcohol-water) condensate | 33% vol. of crude oil | 12.89% | 0.06% | 0.55% |
| 180–240° C. Cut | 21% vol. of crude oil | 12.39% | 0.06% | 0.58% |
| Residue in flask | 20% vol. of crude oil | 11.87% | 0.31% | 1.43% |

Because of the apparatus configuration, the hydrogen could not be introduced close enough to the bottom of the reaction flask to contact the bottommost material; hence, the 20% residue.

EXAMPLE IV

One hundred fifty grams of a light Arab crude oil, 2 grams of elemental sulfur, and 40 milliliters of a methanol solution containing 15.6 grams of KHS and 7.8 grams of water (bound in the empirical hydrate) were charged to a reaction flask, and the run proceeded as in Example I, except that steam flow was commenced at 130° C. Analyses of the crude oil and recovered products are shown below.

| Material | Analysis | | |
|---|---|---|---|
| | Hydrogen | Nitrogen | Sulfur |
| Crude Oil | 12.25% | 0.1% | 1.8% |
| Below 140° C. Cut | 13.8% | <0.05% | 0.09% |
| 140–170° C. Cut | 13.5% | <0.05% | 0.12% |
| 170–270° C. Cut | 13.1% | 0.07% | 2.3% |
| 270–330° C. Cut | 12.8% | 0.11% | 0.8% |

EXAMPLE V

A straight-run vacuum resid (produced with an initial boiling point under vacuum of 593° C.) and a methanol solution of KHS (0.47 grams KHS/milliliter solution) were charged to a reaction flask. Heating was commenced and the reactor contents were agitated with nitrogen from ambient temperature to 170° C., at which point the nitrogen flow was halted and steam flow was commenced. The run was halted when the bulk resid temperature reached 400° C., at which time the residue remaining in the flask was 51% of that initially charged. Analyses of the resid feedstock and of the two distillates are shown below.

| Material | Analysis | | |
|---|---|---|---|
| | Hydrogen | Nitrogen | Sulfur |
| Resid | 10.51% | 0.52% | 3.83% |
| Below 110° C. Cut | 12.02% | 0.22% | 2.61% |
| 110–400° C. Cut | 11.41% | 0.21% | 2.96% |

EXAMPLE VI

The straight-run vacuum resid of Example V was again treated with KHS reagent, this time using hydrogen to agitate the system from ambient temperature to 240° C. Steam flow commenced at 170° C. The run was halted at 425° C., at which time the coked material left in the reactor amounted to 9% of the resid initially charged. Analyses of the resid, of the two distillates collected, and of the residue in the flask are shown below.

| Material | Analysis | | |
|---|---|---|---|
| | Hydrogen | Nitrogen | Sulfur |
| Resid | 10.51% | 0.52% | 3.83% |
| Below 360° C. Cut | 12.17% | 0.13% | 2.41% |
| 360–425° C. Cut | 12.29% | 0.11% | 1.95% |
| Residue in flask and condenser washings | 6.67% | 0.23% | 2.46% |

Chromatographic analysis of the uncondensed gas stream indicated that it contained 30.52% hydrocarbons, broken down as follows.

| Compound(s) | Percent of Gas Stream Hydrocarbon |
|---|---|
| Methane | 59% |
| Ethane + Ethylene | 21% |
| Propane + Propylene | 6% |
| Butanes | 6% |
| Pentanes | 2% |

The rest of the gas stream (69.48%) is believed to have been air in the gas chromatography tube. The condensed distillates were very light, no heavier than #2 heating oil or diesel fuel. Additionally, the absence of any precipitate in the effluent gas scrubber, containing an alcoholic solution of KOH, indicated that little or no carbon dioxide was produced in the reactor.

EXAMPLE VII

One hundred fifty milliliters of a different vacuum resid and 22 milliliters of a methanol solution containing KHS (0.477 gram of KHS per milliliter of solution) were charged to a reaction vessel and heated. Nitrogen agitation was used from ambient temperature to 190° C., at which time the nitrogen was stopped and the flow of steam (superheated to 140° C.) was commenced. A single distillate was collected and kept at 100° C. to drive off the water. Those hydrocarbons that did not distill off with the water are denominated the "100°–425° C. Cut," and those that did distill off as the "Below 100° C. Cut." Analyses of the resid, of the two hydrocarbon products, and of the residue in the flask are shown below:

| Material | Amount | Analysis | | |
|---|---|---|---|---|
| | | Hydrogen | Nitrogen | Sulfur |
| Resid | 150 ml | 10.85% | 0.44% | 2.91% |
| Below 100° C. Cut | 27 ml | 12.92% | 0.07% | 1.03% |
| 100–425° C. Cut | 110 ml | 12.08% | 0.25% | 2.26% |
| Residue in flask | 20 g | 3.02% | 1.25% | 4.47% |

EXAMPLE VIII

Example VII was repeated, the only change being the use of hydrogen instead of nitrogen, from ambient temperature to the final temperature of 425° C. At the end of the run, the same amount of residue (20 grams) remained in the flask. Analyses of the resid and of the single distillate are shown below.

| Material | Analysis | | |
|---|---|---|---|
| | Hydrogen | Nitrogen | Sulfur |
| Resid | 10.85% | 0.44% | 2.91% |

-continued

| Material | Analysis | | |
|---|---|---|---|
| | Hydrogen | Nitrogen | Sulfur |
| Distillate | 12.19% | 0.17% | 1.95% |

EXAMPLE IX

One hundred sixty milliliters of the vacuum resid of Examples VII and VIII and 25 grams of dry, commercially available NaHS flakes (technical grade) were changed to a reaction flask. Methanol was added to the steam generator. Hydrogen agitation was used throughout, with steam flow commencing at 220° C. Analyses of the resid and of the single distillate are shown below.

| Material | Analysis | | |
|---|---|---|---|
| | Hydrogen | Nitrogen | Sulfur |
| Resid | 10.85% | 0.44% | 2.91% |
| Distillate | 12.07% | 0.18% | 2.53% |

EXAMPLE X

A cracked resid and an alcoholic solution of KHS (0.47 grams of KHS per milliliter of solution) were charged to a reaction flask. Nitrogen agitation was used from ambient temperature to 190° C., at which point nitrogen flow was halted and steam flow was commenced. At the end of the run, 13.3% of the resid remained (in uncoked form) in the flask. The single distillate was held at 100° C. to vaporize the condensed water. Hydrocarbons vaporized with the water were recovered and dried and are denominated the "Below 100° C. Cut." Analyses of the resid and of the two products are shown below.

| Material | Analysis | | |
|---|---|---|---|
| | Hydrogen | Nitrogen | Sulfur |
| Resid | 10.45% | 0.53% | 3.33% |
| Below 100° C. Cut | 12.55% | <0.05% | 1.91% |
| Over 100° C. Cut | 11.84% | 0.2% | 2.57% |

EXAMPLE XI

Example X was repeated except that hydrogen, and not nitrogen, was used from ambient temperature to the final temperature of 450° C., with minimal amounts of steam. Analyses of the resid and of the three distillates are shown below.

| Material | Amount | Analysis | | |
|---|---|---|---|---|
| | | Hydrogen | Nitrogen | Sulfur |
| Resid | — | 10.45% | 0.53% | 3.33% |
| Cut 1 | 20% of total distillate | 12.66% | 0.08% | 2.12% |
| Cut 2 | 30% of total distillate | 11.98% | 0.15% | 2.34% |
| Cut 3 | 50% of total distillate | 11.6% | 0.25% | 2.2% |

EXAMPLE XII

Example XI was repeated except that NaHS flakes (technical grade) were charged directly to the reactor and methanol was added to the steam generator, instead of using the alkanolic solution of KHS. Analyses of the resid and of the two distillates are shown below.

| Material | Analysis | | |
|---|---|---|---|
| | Hydrogen | Nitrogen | Sulfur |
| Resid | 10.45% | 0.53% | 3.33% |
| Cut 1 | 12.36% | 0.07% | 1.99% |
| Cut 2 | 11.79% | 0.18% | 2.12% |

EXAMPLE XIII

One hundred twenty-five milliliters of a cracked, desulfurized resid, 1.8 grams of elemental sulfur, and 25 milliliters of an ethanol solution of KHS (0.24 grams of KHS per milliliter of solution) were placed in a flat-bottom flask, which rested on a hot plate and contained a magnetic stir bar. The vessel contents were stirred rapidly and heated to 120° C. to drive off the ethanol and water from the reagent solution, and heating continued. Steam flow was commenced at 130° C. and continued to the final temperature of 325° C. Analyses of the resid, of the two distillates, and of the residue in the flask are shown below.

| Material | Amount | Analysis | | |
|---|---|---|---|---|
| | | Hydrogen | Nitrogen | Sulfur |
| Resid | 125 g | 9.08% | 0.45% | 1.81% |
| Low-temp. Cut | 57 ml | 11.84% | 0.06% | 0.70% |
| High-temp. Cut | — | 9.77% | 0.35% | 1.91% |
| Residue in flask | — | 8.75% | 0.43% | 1.91% |

EXAMPLE XIV

In this run, hydrogen sulfide was co-fed to a two-stage reactor to treat a vacuum resid. Fifty milliliters of a methanol solution of potassium hydrosulfide empirical dihydrate (0.38 grams KHS/ml solution) were placed in the first reaction stage, a vertical, cylindrical vessel with a total volume of approximately 1 liter and equipped with a heating mantel. Twenty-five milliliters of reagent solution were placed in the second reaction stage, a round flask, equipped with a heating mantel. Gas fed to the first stage was introduced under the surface of the liquid therein and near the bottom of the vessel by a sparge tube. Similarly, vapor overhead from the first stage was fed to the second stage under the surface of the liquid therein by a sparge tube. Vapor from the second stage was cooled and partially condensed in a water-cooled unit.

At the start of the run, several hundred grams of the vacuum resid were heated (so that the resid would flow) and placed in an addition vessel directly above the first-stage reactor. Some of the resid was permitted to enter that reactor, and both reactors were heated. At the same time, the flow of steam, nitrogen, and hydrogen sulfide into the first-stage reactor was commenced. The $H_2S$ flow could not be measured, but it was estimated to be 3 gram-moles/hour. As the temperature rose in the first stage, the methanol and water of empirical hydration added with the reagent distilled and entered the second stage, which was at 110° C. to prevent condensation of water therein.

Reaction in the first stage commenced at approximately 370° C. Over the course of the run, the temperature in the first stage rose from 370° to 390° C. and that in the second stage from 110° to 270° C. A total of 286 grams of resid were added to the first stage during the run, and less than 10 grams remained in the first stage at the end. Analyses of the vacuum resid, product retained in the second reaction stage, and product collected from the water-cooled unit are given below.

| Material | Amount | Analysis | | |
|---|---|---|---|---|
| | | Hydrogen | Nitrogen | Sulfur |
| Vacuum Resid | 286 g | 10.04% | 0.64% | 2.02% |
| Second-stage Product | 57.1 g | 11.22% | 0.42% | 1.48% |
| Final Product | 186.5 g | 12.99% | 0.50% | 1.19% |

The final product has an initial boiling point of 23° C., and a peak distillation temperature of 118° C. Uncondensed product vapor was estimated to approximately 35 grams. The second-stage and final products were 17.4 and 50.4 degrees API at 60° F., respectively, compared to 6.0 for the vacuum resid. Metals content are given below (figures are in parts per million; "N/D" indicates none detectable).

| Material | Analysis | | | | |
|---|---|---|---|---|---|
| | Na | V | K | Fe | Ni |
| Vacuum Resid | 2.6 | 102 | 2.3 | 24 | 62 |
| Second-stage Product | 0.35 | N/D | 2.9 | N/D | N/D |
| Final Product | 1.6 | N/D | 46 | 0.93 | N/D |

EXAMPLE XV

Shale oil was treated in the first-stage reactor of Example XIV using a methanol solution of KHS, steam, and nitrogen, but no $H_2S$. Analyses of the shale oil, products, and residue in the reactor are given below.

| Material | Amount | Analysis | | |
|---|---|---|---|---|
| | | Hydrogen | Nitrogen | Sulfur |
| Shale Oil | 200 g | 9.90% | 1.45% | 6.23% |
| Below 280° C. Cut | 22 g | 10.33% | 1.16% | 6.85% |
| 280–300° C. Cut | 35 g | 10.59% | 0.95% | 6.80% |
| Residue | 100 g | 8.33% | 1.47% | 5.76% |

By difference, uncondensed volatiles total approximately 43 grams. Metals content are given below (unless otherwise noted, figures in parts per million; "N/D" indicates none detectable).

| Material | Analysis | | | | | |
|---|---|---|---|---|---|---|
| | Na | V | K | Fe | Ni | Ca |
| Shale Oil | 11 | 124 | 64 | 106 | 86 | 1223 |
| Below 280° C. Cut | 1.2 | 5 | 5 | N/D | 20 | — |
| 280–300° C. Cut | 0.61 | 19 | 4.6 | N/D | N/D | — |
| Residue | 21 | 56 | 2.89% | 34 | 565 | — |

EXAMPLE XVI

A heavy crude oil of 10.5 degrees API at 60° F. was treated with reagent, steam, and hydrogen sulfide using the apparatus and procedure of Example XIV, except that the second-stage reactor was not used and 100 milliliters of reagent solution were employed. A single product was obtained at 370°–390° C. Analyses of the crude oil and product are given below. At the end of the run less than 2 percent of the crude oil remained in the reactor.

| Material | Analysis | | |
|---|---|---|---|
| | Hydrogen | Nitrogen | Sulfur |
| Crude Oil | 10.80% | 0.40% | 4.42% |
| Product | 11.69% | 0.13% | 3.15% |

The product was 24.3 degrees API at 60° F. and had an initial boiling point of 110° C. and an end point (97% recovery) of 360° C. Metals content are given below (figures in parts per million; "N/D" indicates none detectable).

| Material | Analysis | | | | |
|---|---|---|---|---|---|
| | Na | V | K | Fe | Ni |
| Crude Oil | 5 | 203 | 3 | 6 | 99 |
| Product | 0.06 | N/D | N/D | 0.66 | N/D |

Many variations and modifications will be apparent to one skilled in the art and the claims are intended to cover all variations and modifications that fall within the true spirit and scope of this invention.

I claim:

1. A process for hydrogenating, hydrocracking, denitrogenating, and demetallizing carbonaceous material to produce principally normally liquid hydrocarbon products of increased hydrogen content as compared to the carbonaceous material, comprising contacting the carbonaceous material in a reaction vessel with steam and an empirical hydrate of a sulfur-containing compound selected from the group consisting of alkali metal hydrosulfides, alkali metal monosulfides, and alkali metal polysulfides and recovering the said hydrocarbon products, there being essentially no liquid water present during such contacting.

2. The process of claim 1 wherein the alkali metal is sodium, lithium, potassium, or rubidium.

3. The process of claim 1 further comprising feeding hydrogen sulfide to the reaction vessel to contact the vessel contents.

4. The process of claim 1 wherein hydrogen sulfide is withdrawn from the reaction vessel and is recycled and fed to the reaction vessel to contact the vessel contents.

5. The process of claim 1 wherein the bulk temperature of the carbonaceous material is from 40 to 410 degrees Centigrade and the pressure in the vessel is approximately atmospheric.

6. The process of claim 1 further comprising feeding hydrogen to the reaction vessel to contact the vessel contents.

7. The process of claim 1 further comprising feeding elemental sulfur to the reaction vessel to adjust the ratio of sulfur to alkali metal.

8. A process for hydrogenating, hydrocracking, denitrogenating, and demetallizing carbonaceous material to produce principally normally liquid hydrocarbon products of increased hydrogen content as compared to the carbonaceous material, comprising contacting the carbonaceous material in a reaction vessel with steam and an empirical hydrate of an alkali metal hydrosulfide and recovering the said hydrocarbon products, there being essentially no liquid water present during such contacting.

9. The process of claim 8 wherein the alkali metal is sodium, lithium, potassium, or rubidium.

10. The process of claim 8 wherein the alkali metal hydrosulfide in the reaction vessel is dissolved in an alcohol solution.

11. The process of claim 8 further comprising feeding hydrogen sulfide to the reaction vessel to contact the vessel contents.

12. The process of claim 8 wherein hydrogen sulfide is withdrawn from the reaction vessel and is recycled and fed to the reaction vessel to contact the vessel contents.

13. The process of claim 8 further comprising feeding elemental sulfur to the reaction vessel to adjust the ratio of sulfur to alkali metal.

14. The process of claim 8 further comprising feeding hydrogen to the reaction vessel to contact the vessel contents.

15. The process of claim 8 wherein the bulk temperature of the carbonaceous material is from 40 to 410 degrees Centigrade and the pressure in the vessel is approximately atmospheric.

16. A process for hydrogenating, hydrocracking, denitrogenating, and demetallizing carbonaceous material to produce principally normally liquid hydrocarbon products of increased hydrogen content as compared to the carbonaceous material, said process comprising:

(a) contacting the carbonaceous material in a reaction vessel with an empirical hydrate of a sulfur-containing compound selected from the group consisting of alkali metal hydrosulfides, alkali metal monosulfides, and alkali metal polysulfides;

(b) maintaining the vessel contents at a temperature high enough so that there is essentially no liquid water in the vessel during contacting;

(c) feeding steam to the reaction vessel to contact the vessel contents;

(d) withdrawing vapors from the reaction vessel, said vapors containing the said hydrocarbon products; and (e) recovering the said hydrocarbon products from the withdrawn vapors.

17. The process of claim 16 wherein the alkali metal is sodium, lithium, potassium, or rubidium.

18. The process of claim 16 wherein the alkali metal hydrosulfide in the reaction vessel is dissolved in an alcohol solution.

19. The process of claim 18 wherein the alkali metal hydrosulfide is potassium hydrosulfide or sodium hydrosulfide and the alcohol is methanol or ethanol.

20. The process of claim 16 further comprising feeding hydrogen sulfide to the reaction vessel to contact the vessel contents.

21. The process of claim 16 wherein hydrogen sulfide withdrawn from the reaction vessel is recycled and fed to the reaction vessel to contact the vessel contents.

22. The process of claim 16 wherein elemental sulfur is fed to the reaction vessel to adjust the ratio of sulfur to alkali metal.

23. The process of claim 16 further comprising feeding hydrogen to the vessel to contact the vessel contents.

24. The process of claim 16 wherein the bulk temperature of the carbonaceous material is from 40 to 410 degrees Centigrade.

25. A process of hydrogenating, hydrocracking, denitrogenating, and demetallizing carbonaceous material to produce principally normally liquid hydrocarbon products of increased hydrogen content as compared to the carbonaceous material, said process comprising:

(a) contacting the carbonaceous material with an empirical hydrate of an alkali metal hydrosulfide selected from the group consisting of potassium hydrosulfide and sodium hydrosulfide in a reaction vessel;

(b) maintaining the vessel contents at a temperature high enough so that there is essentially no liquid water in the vessel during contacting;

(c) feeding steam to the vessel to contact the vessel contents;

(d) withdrawing vapors from the reaction vessel, said vapors containing the said hydrocarbon products; and (e) recovering the said hydrocarbon products from the withdrawn vapors.

26. The process of claim 25 wherein the alkali metal hydrosulfide in the reaction vessel is dissolved in methanol, ethanol, or propanol-1.

27. The process of claim 25 wherein elemental sulfur is fed to the reaction vessel to adjust the ratio of sulfur to alkali metal.

28. The process of claim 25 further comprising feeding hydrogen to the reaction vessel to contact the vessel contents.

29. The process of claim 25 further comprising feeding hydrogen sulfide to the reaction vessel to contact the vessel contents.

30. The process of claim 25 wherein potassium hydrosulfide is used and the sulfur to potassium ratio in the reaction vessel is from 0.55/1 to 1.5/1.

* * * * *

UNITED STATES PATENT AND TRADEMARK OFFICE

CERTIFICATE OF CORRECTION

PATENT NO. : 4,606,812

DATED : August 19, 1986

INVENTOR(S) : Rollan Swanson

It is certified that error appears in the above-identified patent and that said Letters Patent is hereby corrected as shown below:

Col. 9, Line 62, "0 05%" should be --0.05%--

Col. 12, Line 12, "changed" should be --charged--

Title page:

[75] Inventor: Address "Eureka, Nebr." should be --Eureka, Nev.--.

[73] Assignee: "Chemroll Enterprises, Inc., New York, N. Y." should be deleted.

[57] Abstract: line 6, "preferred " should read --In an embodiment,--.

Signed and Sealed this

Thirteenth Day of December, 1988

*Attest:*

DONALD J. QUIGG

*Attesting Officer*

*Commissioner of Patents and Trademarks*